US010113298B2

(12) United States Patent
Armas

(10) Patent No.: US 10,113,298 B2
(45) Date of Patent: Oct. 30, 2018

(54) REAR ATTACHMENT

(71) Applicant: David Armas, Homestead, FL (US)

(72) Inventor: David Armas, Homestead, FL (US)

( * ) Notice: Subject to any disclaimer, the term of this patent is extended or adjusted under 35 U.S.C. 154(b) by 15 days.

(21) Appl. No.: 14/578,417

(22) Filed: Dec. 20, 2014

(65) Prior Publication Data

US 2016/0177536 A1 Jun. 23, 2016

(51) Int. Cl.

| | |
|---|---|
| ***E02F 3/96*** | (2006.01) |
| ***E02F 3/36*** | (2006.01) |
| *E02F 3/76* | (2006.01) |
| *E02F 5/32* | (2006.01) |

(52) U.S. Cl.

CPC ..... *E02F 3/961* (2013.01); *E02F 3/3627* (2013.01); *E02F 3/3668* (2013.01); *E02F 3/3672* (2013.01); *E02F 3/7604* (2013.01); *E02F 5/32* (2013.01)

(58) Field of Classification Search

CPC ..... A01B 59/06; A01B 59/062; A01B 59/063; A01B 59/065; A01B 59/066; A01B 59/067; A01B 59/068; A01B 63/002; A01B 63/02; A01B 63/06; A01B 63/10; A01B 63/102; A01B 63/1145; E02F 3/3604; E02F 3/3627; E02F 3/3631; E02F 3/3668; E02F 3/3672; E02F 3/369; E02F 3/3695; E02F 3/627; E02F 3/6454; E02F 3/6463; E02F 3/652; E02F 3/653; E02F 3/7622; E02F 3/7631; E02F 3/7604; E02F 3/961

USPC ..... 37/268, 435; 172/272, 684.5; 414/703

See application file for complete search history.

(56) References Cited

U.S. PATENT DOCUMENTS

| | | | | |
|---|---|---|---|---|
| 3,237,795 A * | 3/1966 | Kromer | E02F 3/3622 | 172/272 |
| 5,392,538 A * | 2/1995 | Geerligs | E01H 5/061 | 37/236 |
| 5,743,339 A * | 4/1998 | Alexander, III | A01B 59/062 | 172/272 |
| 9,624,641 B2 * | 4/2017 | Martin | E02F 3/3627 | |
| 9,677,248 B2 * | 6/2017 | Nakano | B60K 15/05 | |
| 2015/0020892 A1 * | 1/2015 | Behr | F16L 37/08 | 137/15.09 |

FOREIGN PATENT DOCUMENTS

| | | | | |
|---|---|---|---|---|
| GB | 929541 A * | 6/1963 | A01B 35/14 | |

* cited by examiner

*Primary Examiner* — Saul Rodriguez
*Assistant Examiner* — Brendan P Tighe
(74) *Attorney, Agent, or Firm* — Christopher J. Vandam, PA; Chris Van Dam

(57) ABSTRACT

An attachment for the rear of a skid steer type vehicle to connect any of a variety of commercially available attachments to the rear of that vehicle. A pair of hydraulic actuators articulate the arm assembly relative to the plate assemblies affixed to the vehicle to raise and lower the attachment.

4 Claims, 4 Drawing Sheets

REAR ATTACHMENT

BACKGROUND OF THE INVENTION

1. Field of the Invention

The present invention relates to construction equipment and more particularly, to accessories attached to a vehicle such as a small to medium skid steer vehicle.

2. Description of the Related Art

Several designs for construction and utility vehicle attachments have been designed in the past. None of them, however, includes a rearward facing means to attach a universal style attachment to a skid steer vehicle or similar machine.

Skid steer vehicles and similar machines are specifically designed to work with many types of commercial attachments such as dozer blades, buckets, mowers, scarifiers, brushes, pallet or hay forks and many other types. None can carry two attachments, one full functioning on the front and another with limited hydraulic power available on the rear of the vehicle.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a bolt on adapter for attaching any of a wide variety of commercially available utility attachments to a skid steer vehicle.

It is another object of this invention to provide a way increase the utility of a skid steer to simultaneously use and or transport two attachments.

It is still another object of the present invention to provide an efficient system for swapping two attachments in the field away from other support vehicles so that two tasks can be readily completed with minimal lost time exchanging implements.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
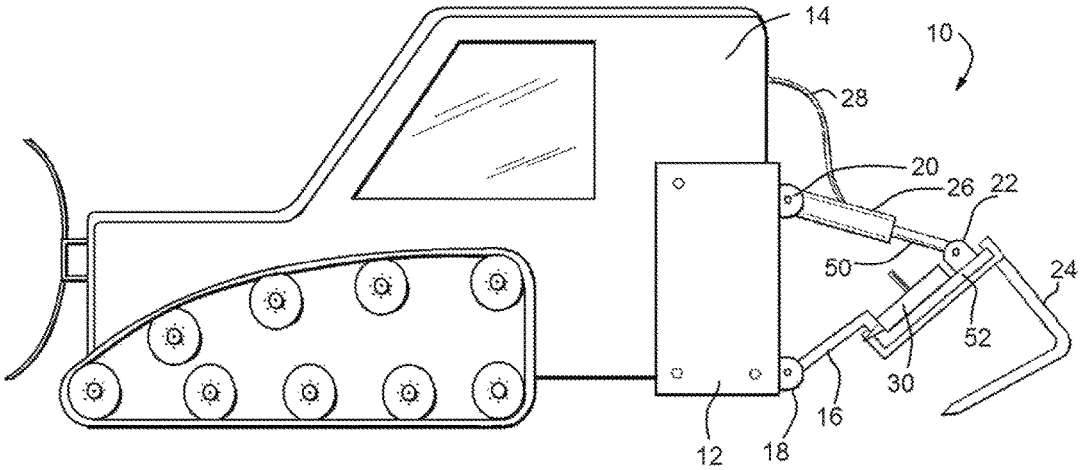
FIG. 1 represents an elevation view of a tracked vehicle with a version of the device attached to the rear and including an example attachment.
Figure 2:
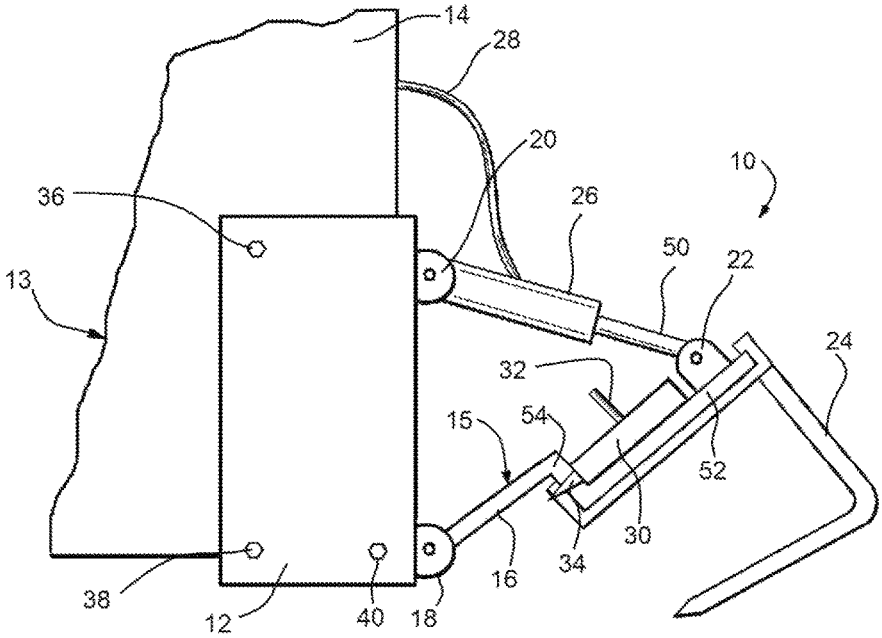
FIG. 2 shows a partial elevation showing in more detail the version of the device as shown in FIG. 1 and also including an example attachment.
Figure 3:
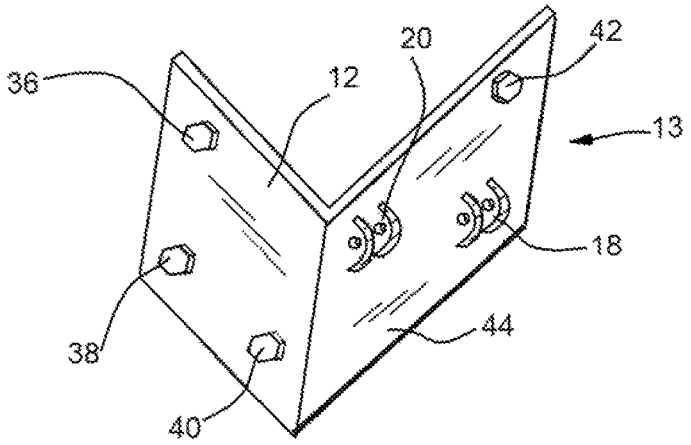
FIG. 3 illustrates a perspective view of a plate assembly separated from other elements of the design.
Figure 4:
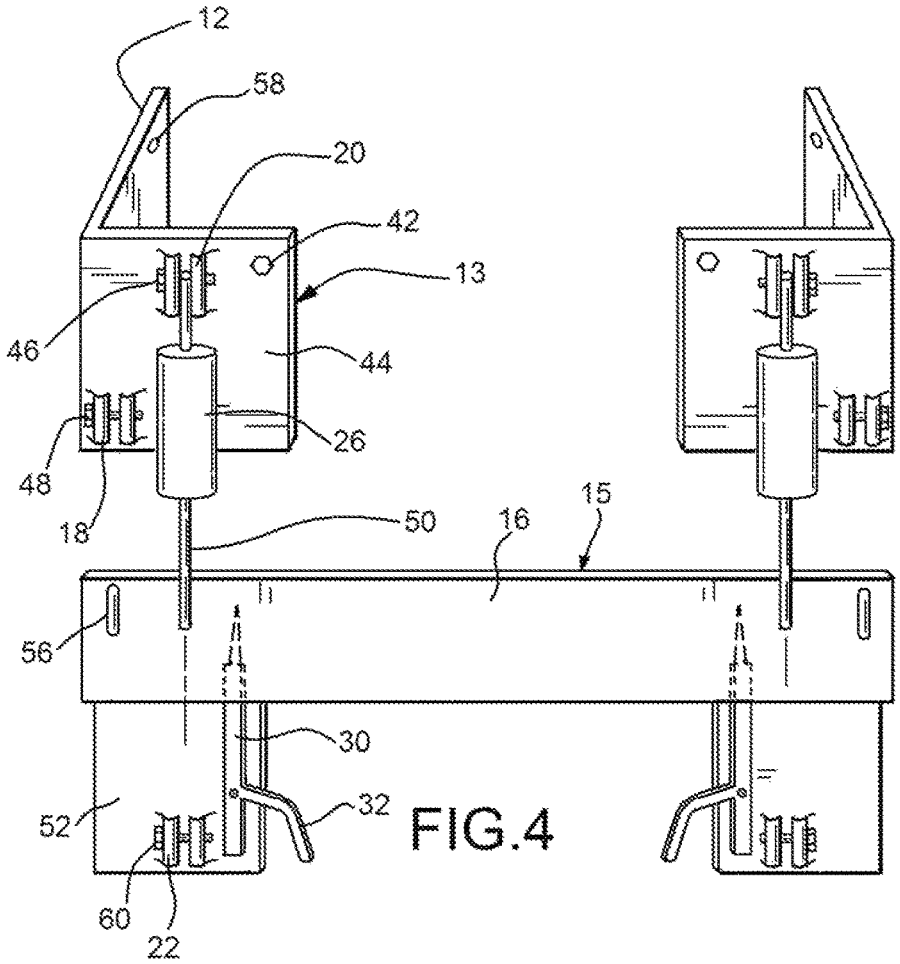
FIG. 4 is a representation of an exploded perspective view including examples of a plate assembly and an arm assembly separated to emphasize interaction between these important elements.
Figure 5:
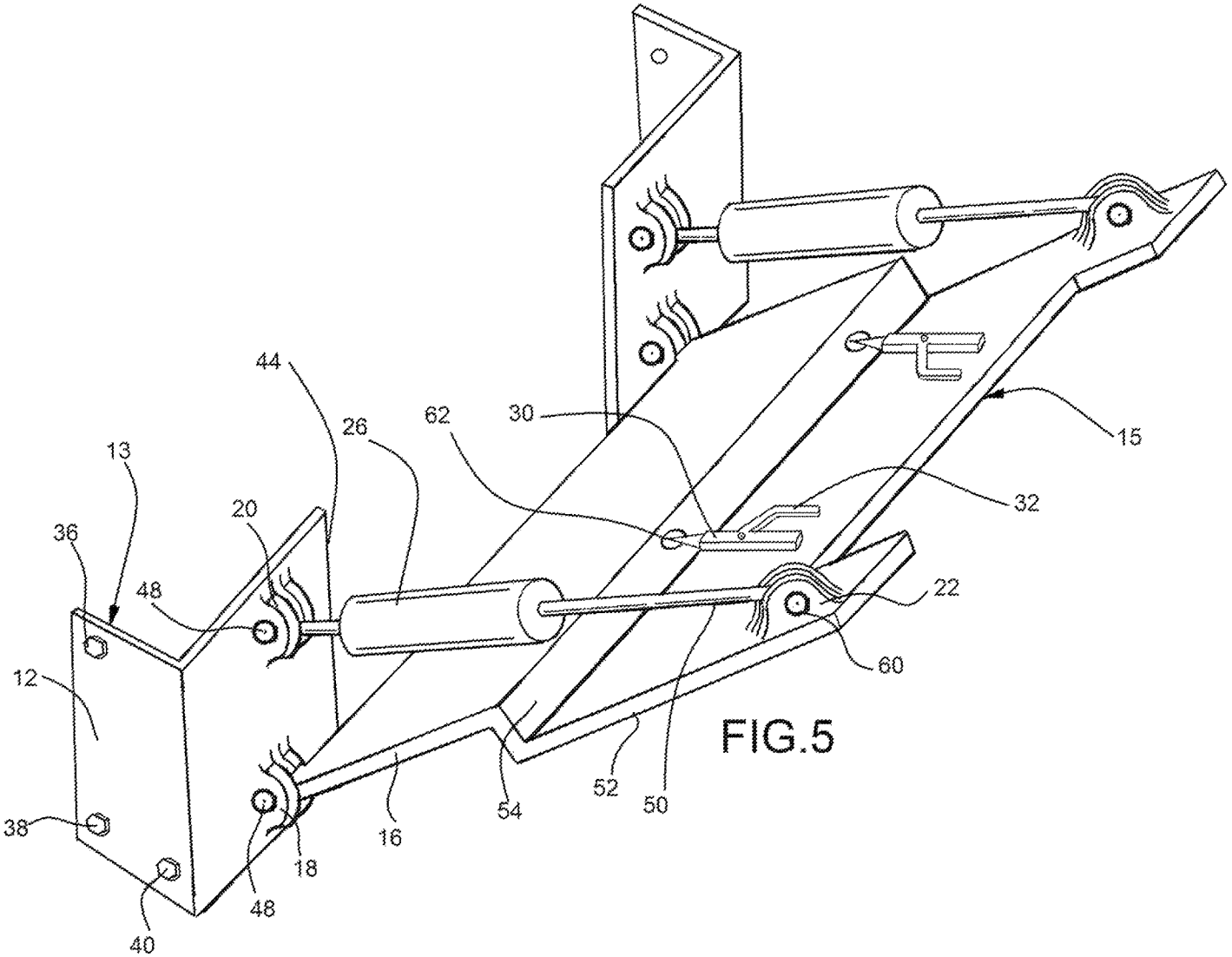
FIG. 5 is a perspective view of a rear attachment.

Referring now to the drawings, where the present invention is generally referred to with numeral 10, it can be observed that it basically includes a plate assembly 13 and an arm assembly 15. Vehicle 14 is shown primarily for context. Attachment 24 is merely but one example of an attachment compatible with the device and is shown for context and possible use of the device.

In some views many elements are visible but are called out by number on one side. It is apparent from the drawings that the device is essentially symmetrical with the right side being similar to the left side that is numbered. Perfect symmetry is not required but generally any component on the left has a counterpoint on the right side of the machine that performs a similar function.

Sub-components of the plate assembly 13 and arm assembly include, but are not necessarily limited to, a plate 12, an arm 16, a hinge 18, a hinge 20, a hinge 22, a hydraulic 26, a hose 28, a lock 30, a handle 32, a spike 34, a fastener 36, a fastener 38, a fastener 40, a fastener 42, a plate 44, a pin 46, a pin 48, a rod 50, a plate 52, a plate 54, a hinge 56, an aperture 58, a pin 60 and an aperture 62.

Figure 6:
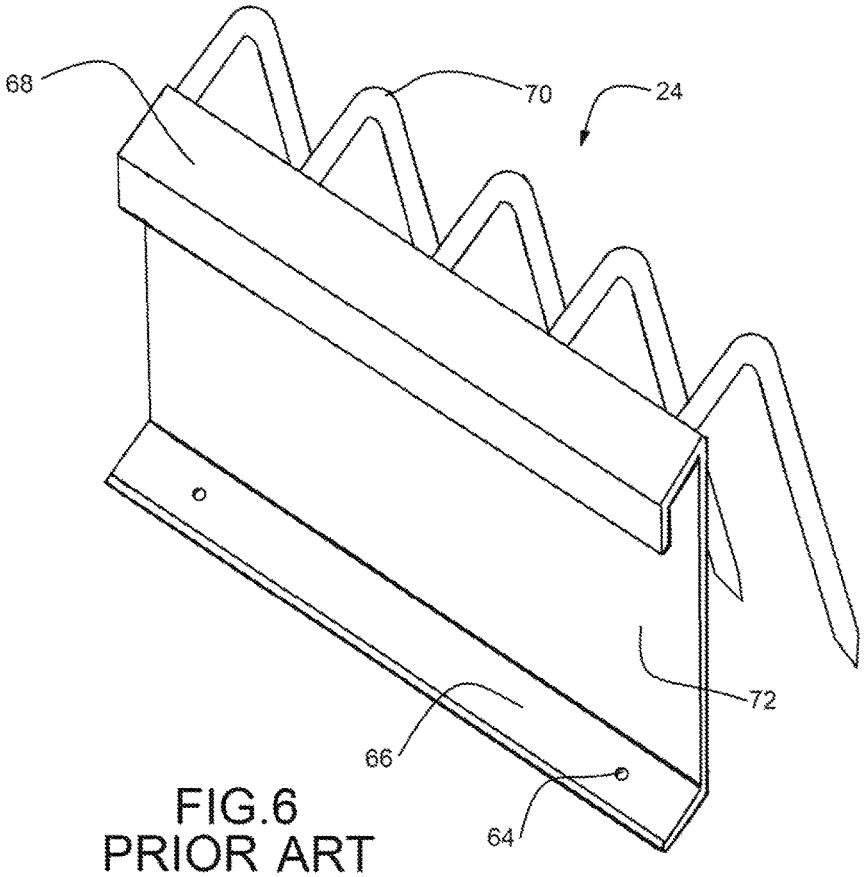
FIG.6 PRIOR ART
FIG. 6 is a perspective view of a prior art attachment.

The attachment 24, shown in isolation in FIG. 6, is an example of prior art that also includes an aperture 64, a plate 66, a hook 68, several tines 70 and a plate 72. The attachment 24 can generally be recognized as a scarifier attachment and is but one in a large family of universal vehicle utility attachments.

Looking at figures in combination, a complete example of a small to medium sized skid steer vehicle 14 is shown with a version of the invention. The vehicle 14 can be any type of vehicle compatible with a wide variety of attachments.

Skid steer vehicles typically have a motor on the rear of the machine. The motor is mounted into the vehicle 14 on a support structure that is rigid and strong enough to survive the rigors of its duties. The plate assembly 13 is affixed to the rear of the vehicle 14 by means of fasteners 36, 38 and 40 through the plate 12 and fastener 42 through the plate 44. The fasteners 36, 38 and 40 are preferably threaded bolts so that the entire device can be installed and removed from the vehicle with common mechanics tools.

It may be possible to use other types of commonly available fasteners such as clips, pins, rivets, welds or other such means available in the art. In some applications it may be preferred or necessary to permanently affix the device onto the vehicle.

It will be appreciated that the precise locations of the fasteners 36, 38, 40 and 42 may be different from applications on one type or brand of vehicle 14 than may be on another. Due to the stresses on the vehicle and components of the device it may be preferred to attach the device to a structural component such as the frame or reinforced body panels, dependent on the specific machine.

The arm assembly 15 is generally a unified, rigid component comprised of the arm 16 and the plate 52 (one on each the left and right) connected by plate 54. Arm 16 includes an integral hinge 56 element near the bottom edge that interfaces with the opposing hinge 18 on the plate 44 of the plate assembly 13. A pin 48 passes through both hinge 56 and hinge 18 to form an articulating joint that allows movement of the arm assembly 15 relative to the plate assembly 13.

On the upper edge of the plate 52 on the arm assembly 15 is the hinge 22 that connects to the end of the hydraulic rod 50. The end of the rod 50 is moveably affixed to the hinge 22 by means of the pin 60. The hinge 22 allows free articulation between the plate assembly 13 and the arm assembly 15.

The other end of the hydraulic 26 is affixed to hinge 20 on the upper side of the plate 44 of the plate assembly 13. A pin 48 secures the end of the hydraulic 26 to the hinge 20 and also allows free articulation between the hydraulic 26 and plate assembly 13.

The hydraulic 26 extends and retracts under hydraulic pressure provided by the vehicle 14 via hose 28. Other versions of the device can substitute other motive means for the hydraulic 26 such as an electric motor, linear actuator, extension bars, threaded extenders or other means to force the articulation of the arm assembly 15 relative to the plate assembly 13 about the hinge 18.

An attachment, such as the scarifier attachment 24, is temporarily attached to the device by maneuvering the hook 68 over the top edge of the plate 52 and lifting the attachment 24 by the hook 68 so that the plate 72 comes into contact with the plate 52 and the plate 66 is adjusted to be adjacent to plate 54. The lock 30 can then be activated by utilizing the handle 32 to leverage the spike 34 through the plate 54 and aperture 64 on plate 66 to pin the attachment 24 to the arm assembly 15 for normal use of the device.

The process is reversed for detaching an attachment 24 to the arm assembly 15. Generally the hydraulic 26 is adjusted to the near vertical and the handle 32 is pulled to withdraw the spike 34 from the aperture 64 in the plate 66. This unlocks the attachment 24 from the device. The hydraulic 26 can be extended and/or the vehicle 14 moved to pull the attachment 26 from the arm assembly 15.

Similar to other skid steer vehicle parts and components, the disclosed device is generally made of a rigid and durable material. Steel or other metal alloys are a good choice of material for construction of this rear attachment device.

In one version of the device the attachment geometries of the attachment are materially similar to those used on the factory-supplied front of the vehicle so that the same attachment can be used on the front as in the rear. The functionality of the rear attachment may be limited due to the availability of hydraulic controls for the attachment. The skid steer can be modified or enhanced to provide additional controls to address uses of the rear attachment and the attached accessory.

At least one version of the device can be fairly described as a rear attachment device comprised of, among other elements, a first plate assembly, a second plate assembly and an arm assembly. The first plate assembly is affixed to a predetermined first surface at a rear of a vehicle, for example around the lower left rear corner of the vehicle. The second plate assembly is affixed to a predetermined second surface at the rear of a vehicle, for example at the lower right rear corner of the vehicle. The arm assembly on a first lower edge articulably, possibly at a hinge, attaches to a lower edge of the first plate assembly. The arm assembly on a second lower edge articulably attached to a lower edge of the second plate assembly, again possibly with a hinge. A first hydraulic actuator is articulably affixed at a first end to an upper edge of the first plate assembly and on a second end is articulably affixed to a first upper edge of the arm assembly. The hydraulic actuator may be powered and controlled by the systems of the vehicle. A second hydraulic actuator is articulably affixed at a first end to an upper edge of the second plate assembly and on a second end is articulably affixed to a second upper edge of the arm assembly. The arm assembly is adapted to removably connect to an attachment so that a third party attachment, such as a dozer blade, scarifier or any other commercially available attachment, may be readily connected to and also be readily disengaged from the vehicle. When the first hydraulic actuator and the second hydraulic actuators are selectively simultaneously extended, a relative angle between the arm assembly and first and second plate assemblies increases. In other words, the arm assembly can be moved up and down under force provided by the hydraulics. When the first hydraulic actuator and the second hydraulic actuators are selectively simultaneously retracted, the relative angle between the arm assembly and the first and second plate assemblies decreases. Generally both left and right hydraulic actuators work in concert, they could also be controlled independently, as required by any particular attachment that is connected to the rear attachment device. The arm assembly includes a is lock to selectively secure the attachment to the arm assembly. Typically the lock is a manual connecting means that secures an attachment to the device.

A version of the rear attachment device could also be characterized in that the first plate assembly and the second plate assembly are independently bolted to the vehicle. Welding or other affixing means may be possible in the alternative, depending on the vehicle and version of the rear attachment.

Generally, the vehicle is a small to medium sized skid steer vehicle. It could also be steered vehicles, trucks, pickup trucks, tracked vehicles or any other mobile device that one would want to attach a commercially available implement attachment to, such as a scarifier, dozer blade, mower or other such device.

In some versions of the device, the first hydraulic actuator and the second hydraulic actuator are powered by a hydraulic system integral to the vehicle. Many construction type vehicles have integrated hydraulic pumps that can be used or adapted to be used with an additional attachment on the rear of the vehicle.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

It should be noted that throughout this written description, which is intended to be read in combination with the drawings, the rear attachment is sometimes interchangeably referred to as the invention, device or other similar terms. The masculine may represent the feminine or neuter and singular the plural or vice-versa as may be appropriate by context and a general understanding of other teachings in the art and surrounding classes of art.

What is claimed is:

1. A rear attachment device to connect an implement attachment to a rear of a vehicle comprised of a first plate assembly, a second plate assembly and an arm assembly;

a front of the vehicle is adapted to temporarily connect to the implement attachment with full functionality of the implement attachment;

the implement attachment is any commercial attachment that is adapted to be full functioning when attached to a hydraulic power at a front of the vehicle;

the first plate assembly is affixed to a predetermined first surface at a rear of a vehicle;

the second plate assembly is affixed to a predetermined second surface at the rear of a vehicle;

the arm assembly on a first lower edge articulably attaches with a hinge to a lower edge of the first plate assembly;

the arm assembly on a second lower edge articulably attaches with a hinge to a lower edge of the second plate assembly;

a first hydraulic actuator is articulably affixed at a first end to an upper edge of the first plate assembly and on a second end is articulably affixed to a first upper edge of the arm assembly;

a second hydraulic actuator is articulably affixed at a first end to an upper edge of the second plate assembly and on a second end is articulably affixed to a second upper edge of the arm assembly;

a bracket on the arm assembly is adapted to removably connect to the implement attachment by maneuvering a hook on the implement attachment over a top edge of the arm assembly bracket and lifting the implement attachment without connecting a hydraulic power to the implement attachment;

the hook held over the arm assembly bracket supports a weight of the implement attachment;

when the first hydraulic actuator and the second hydraulic actuators are selectively simultaneously retracted, the relative angle between the arm assembly and the first and second plate assemblies decreases sufficiently to use or carry the implement attachment;

the arm assembly includes a lock to selectively secure the attachment to the bracket on the arm assembly;

wherein the implement attachment is located behind the vehicle when it is affixed to the rear attachment device.

2. A rear attachment device as in claim 1 further characterized in that the first plate assembly and the second plate assembly are independently bolted to the vehicle.

3. A rear attachment device as in claim 1 further characterized in that the vehicle is a small to medium sized skid steer vehicle.

4. A rear attachment device as in claim 1 further characterized in that the first hydraulic actuator and the second hydraulic actuator are powered by a hydraulic system integral to the vehicle.

* * * * *